US007082207B2

(12) United States Patent
Rapps

(10) Patent No.: US 7,082,207 B2
(45) Date of Patent: Jul. 25, 2006

(54) ADJUSTABLE BEHIND-THE-EAR COMMUNICATION DEVICE

(75) Inventor: Gary M. Rapps, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 936 days.

(21) Appl. No.: 10/020,251

(22) Filed: Dec. 14, 2001

(65) Prior Publication Data

US 2003/0112991 A1 Jun. 19, 2003

(51) Int. Cl.
*H04R 25/00* (2006.01)

(52) U.S. Cl. ..... 381/381; 381/330

(58) Field of Classification Search ..... 381/328, 381/330, 373–374, 379–382; 181/128, 135; 379/430

See application file for complete search history.

(56) References Cited

U.S. PATENT DOCUMENTS 3,469,651 A * 9/1969 Mendelson et al. ..... 381/380
4,014,320 A * 3/1977 Richards ..... 600/559
4,025,733 A * 5/1977 Klar et al. ..... 2/171.2
4,299,303 A * 11/1981 Clark ..... 181/131
4,727,582 A * 2/1988 de Vries et al. ..... 381/330
5,414,769 A 5/1995 Gattey et al.
D411,885 S 7/1999 Mavrakis et al.
6,009,183 A 12/1999 Taenzer et al.
6,101,259 A 8/2000 Rapps
6,101,260 A 8/2000 Jensen et al.
6,721,433 B1 * 4/2004 Sato ..... 381/381

* cited by examiner

*Primary Examiner*—Suhan Ni
(74) *Attorney, Agent, or Firm*—Terri S. Hughes; Barbara R. Doutre

(57) ABSTRACT

A communication device (200) for use behind the ear comprises a housing having a first section (202) and a second section (206). A sound delivery tube (210) is coupled to the second section of the housing (206). The second section of the housing (206) rotates with respect to the first section of the housing (202) within a prescribed range of angular displacement as to allow user-definable depth adjustability of at least a portion of the sound delivery tube (210) into an ear canal (104). Optionally, the first section of the housing (202) rotates with respect to the second section of the housing (206) to provide a better fit to the shape of the head at the temporal/mastoid plate 120.

19 Claims, 3 Drawing Sheets

FRONT VIEW

SIDE VIEW

ADJUSTABLE BEHIND-THE-EAR COMMUNICATION DEVICE

CROSS-REFERENCE TO RELATED APPLICATION

The present application is related to U.S. Pat. No. 6,009,183, filed 30 Jun. 1998 by Taenzer et al., titled "Ambidextrous Sound Delivery Tube System," the disclosure of which prior application is hereby incorporated by reference, verbatim and with the same effect as though it were fully and completely set forth herein.

The present application is also related to U.S. Pat. No. 6,101,259, filed 03 Aug. 1998 by Rapps, titled "Behind the Ear Communication Device" the disclosure of which prior application is hereby incorporated by reference, verbatim and with the same effect as though it were fully and completely set forth herein.

FIELD OF THE INVENTION

The present invention relates generally to an adjustable behind-the-ear communication device.

BACKGROUND OF THE INVENTION

Behind-the-ear ("BTE") communication devices can be found in many forms. One popular construction is to have a hook shaped member having a main portion that houses device electronics, and a more tightly curved portion that hooks around the point at which the helix joins the head to provide a conduit for sound to the ear canal. Examples of BTE communication devices are described in U.S. Pat. Nos. 6,009,183 and 6,101,259.

An important aspect in any BTE communication device is that of fit for comfortable long-term use. One approach to providing a proper fit is to make BTE communication devices available in a variety of sizes, such that a user may select an appropriate size. Another approach is to custom fit the BTE communication device for a particular user.

For mass market applications, a one size fits all approach yields substantial manufacturing and distribution cost advantages. However, because ears come in a variety of shapes and sizes, many users of current single size BTE communication devices suffer in comfort because the form factor provides a compromised fit, and in some cases a poor fit, and failure to provide for depth positioning of the sound delivery tube in the ear canal.

Thus, there exists a need for a BTE communication device that provides for user adjustable depth positioning of the sound delivery tube in the ear canal.

BRIEF DESCRIPTION OF THE FIGURES

A preferred embodiment of the invention is now described, by way of example only, with reference to the accompanying figures in which.

DETAILED DESCRIPTION OF THE PREFERRED EMBODIMENT

Figure 1:
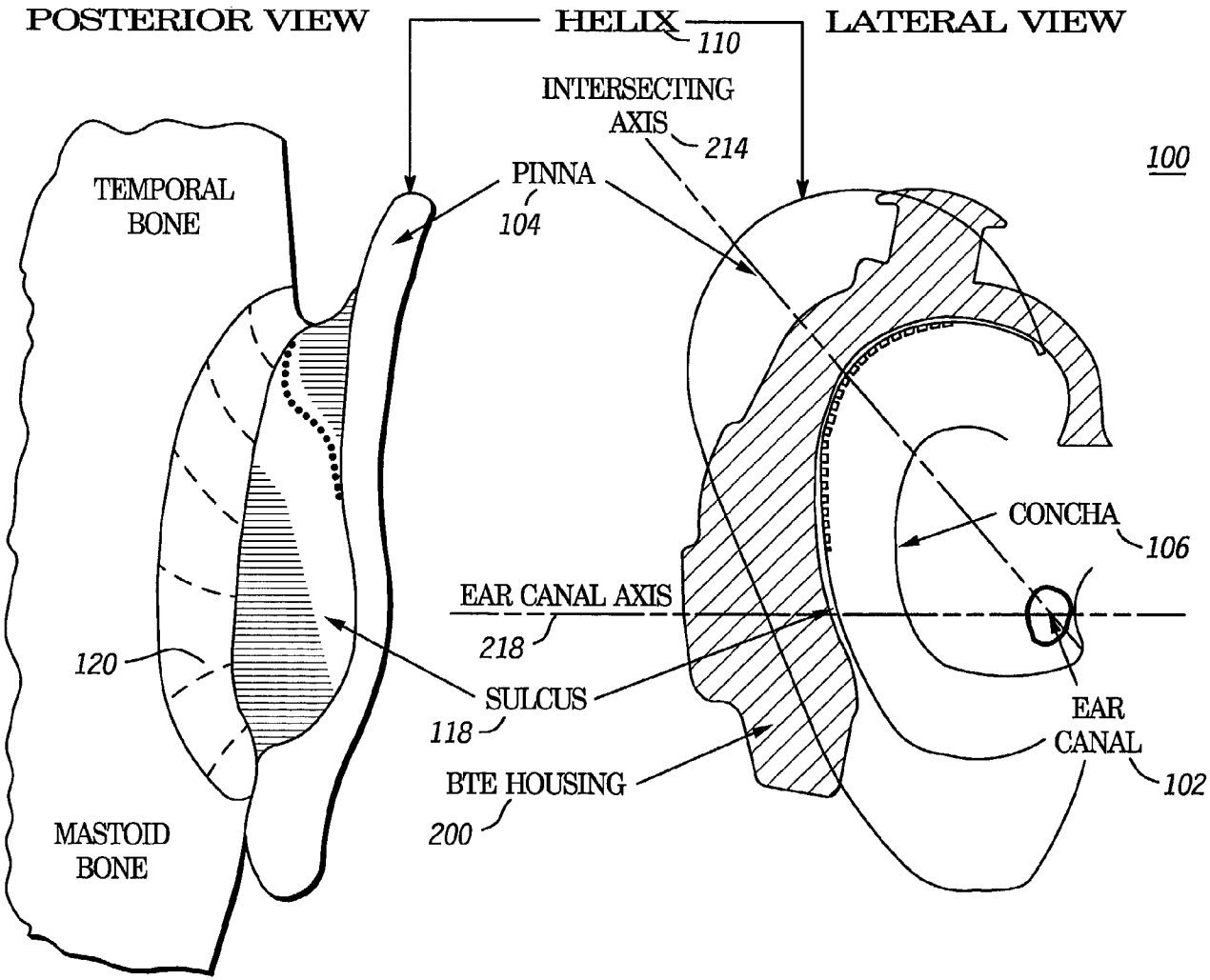
FIG. 1 illustrates a side view of a human head and outer ear.

While the specification concludes with claims defining the features of the present invention that are regarded as novel, it is believed that the present invention will be better understood from a consideration of the following description in conjunction with the corresponding figures, in which like reference numerals are carried forward.

The present invention provides for a behind-the-ear ("BTE") communication device having a form factor that delivers a comfortable fit across a wide variety of users. The form factor stems from a discovery, through anatomical experiments, of a common ear contact surface configuration, formed using tangential arcs, that provides universal comfort and fit for ears of different shapes and sizes, across a major portion of the population.

In particular, the present invention permits the user to configure a sound delivery tube for easy application to his/her ear, and to select the proper depth adjustment as that user sees fit. The present invention provides for user-definable depth positioning of the sound delivery tube in the ear canal, thus providing user comfort and the ability to wear the BTE communication device for an acceptable length of time. The present invention provides for a mode of adjustability that takes into consideration the variation of curvature of the human head around the ear, and allows the user to control the depth of the sound delivery orifice inside the ear canal. Thus, a range of user defined adjustability is provided for matching the BTE communication device to the user's head and ear, to allow different sound tube insertion depths, depending on the user's hearing needs and comfort requirements.

A posterior view and a lateral view of a typical outer ear 100 are shown in FIG. 1 for the purpose of establishing reference elements. The ear 100 has a canal ("ear canal") 102 that extends inward, forward, and slightly upward to an eardrum, and a pinna 104, which is a cartilaginous appendage, that projects in an outward manner. The pinna 104 has a cavity, along a front section of the ear, referred to as a concha 106, which forms a conduit for sound to the ear canal 102. The groove or portion of the ear behind the helix 110 on the backside of the pinna 104 that attaches the ear to the remainder of the head is referred to as the sulcus 118.

Figure 2:
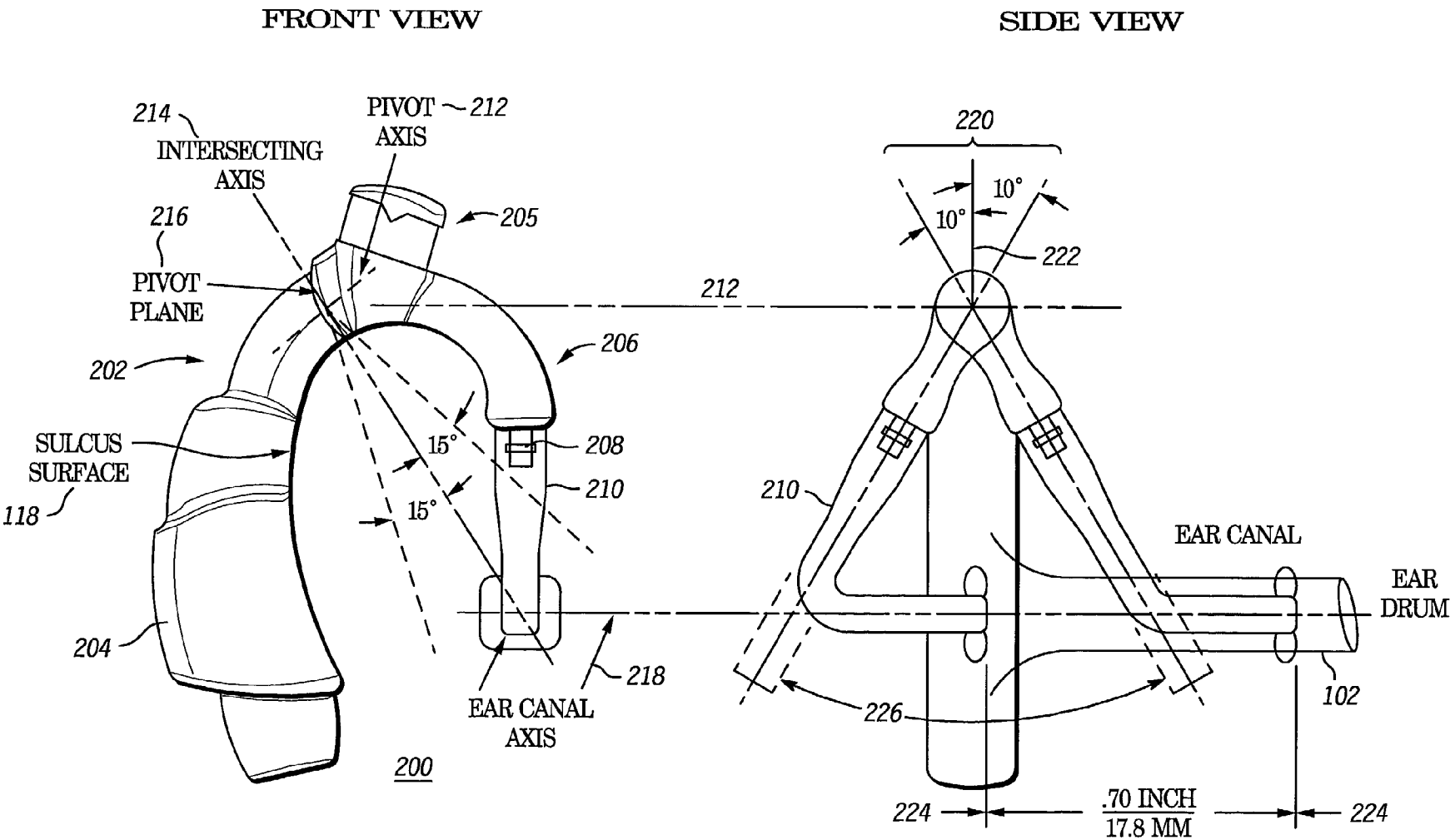
FIG. 2 illustrates a front and side view of an adjustable behind-the-ear ("BTE") communication device in accordance with the preferred embodiment of the present invention.

FIG. 2 illustrates a front view and a side view of a BTE communication device 200 in accordance with the preferred embodiment of the present invention. The BTE communication device 200 comprises a hooked shaped housing having a form factor to fit around the typical human ear 100. Preferably, a first section of the housing 202 houses electronic circuitry (not shown) 204 that receives and processes audio signals. A second section of the housing 206 extends from the first section of the housing 202 and curves in a hook like manner for fitting around the top and front portions of the ear 100. The second section of the housing 206 may or may not house electronic circuitry (not shown) 205 that receives and processes audio signals The housing has a concave "inner" surface that fits behind and around a user's outer ear 100, i.e., the inner surface is that part of the exterior surface of the housing that abuts or makes contact with the sulcus of the ear. A first part of the concave inner surface extends along the first section and a second part of the concave inner surface extends along the second section of the housing.

The second section of the housing 206 has a terminal end 208 that functions as a receptacle or tube mount for an attached sound delivery tube 210 (described in detail below). The sound delivery tube 210 is pivotable about the terminal end 208 of the tubular portion to accommodate left and right ear use (i.e., ambidextrous), and angular corrections to match a user's ear canal axis.

Further, the first section of the housing 202 is coupled to the second section of the housing 206 via a pivot axis 212, or other similar mechanism, which allows the second section of the housing 206 to rotate with respect to the first section of the housing 202 within a prescribed range of angular displacement 220. Generally, the prescribed range of angular displacement 220 allows up to approximately fifteen degrees of angular displacement on at least one side of a neutral axis 222, however, the prescribed range of angular displacement 220 may vary more or less depending on a particular application and still remain within the scope of the present invention. In the preferred embodiment, the prescribed range of angular displacement 220 is twenty degrees (10 degrees on both sides of the neutral axis 222) that provides a range of depth (lateral) adjustment 224 of approximately 0.70 inches (17.8 mm). The twenty degrees in variation enables an accommodating range of adjustment for the variability of ear sizes and shapes.

An intersecting axis 214 is on the pivot plane 216 is perpendicular to the pivot axis 212. This intersecting axis 214 preferably intersects the ear canal axis 218, but is not limited to such. Having the intersecting axis 214 intersect the ear canal axis 218 in the preferred embodiment aligns the horizontal axis of the sound delivery tube 210 with the ear canal axis 218 throughout the entire range of adjustment. This produces the depth (lateral) adjustment 224 (e.g., the 0.70 inch in the preferred embodiment) for the depth of the ear canal 102. Such a configuration provides optimal user-definable depth adjustability of at least a portion of the sound delivery tube 210 into the ear canal 102.

Further, as the temporal/mastoid plate 120 varies in curvature, so varies the angular position of the first section of the housing 202 with respect to the second section of the housing 206. The angular displacement 220 on the pivot axis 216 permits a secondary adjustment 226 of the position of the first section of the housing 202 to provide a better fit to the shape of the head. This secondary adjustment 226 compliments the depth (lateral) adjustment 224 of the sound delivery tube 210 in the ear canal 102, and can occur in tandem. The secondary adjustment 226 may also be made dependent or independent of the depth (lateral) adjustment 224. Thus, it should be noted that while the secondary adjustment 226 is usually made once, the ear depth adjustment 224 could occur numerous times, independent from the other.

It should be noted that the secondary adjustment 226 aids in the application of the BTE communication device 200 to the user's ear (i.e., makes it easier to put on and take off); the sound delivery tube 210 is pivoted out of the way to place the BTE communication device 200 on the ear 100 or remove the BTE communication device 200 from the ear 100. Moreover, the secondary adjustment 226 accommodates eyeglass temple pieces to provide clearance since the eyeglass temple piece and the first section of the housing 202 compete for the same space behind the user's ear (i.e., the sulcus 118). Thus, the secondary adjustment 226 can be readjusted each time the eyeglasses are put on or taken off.

Figure 3:
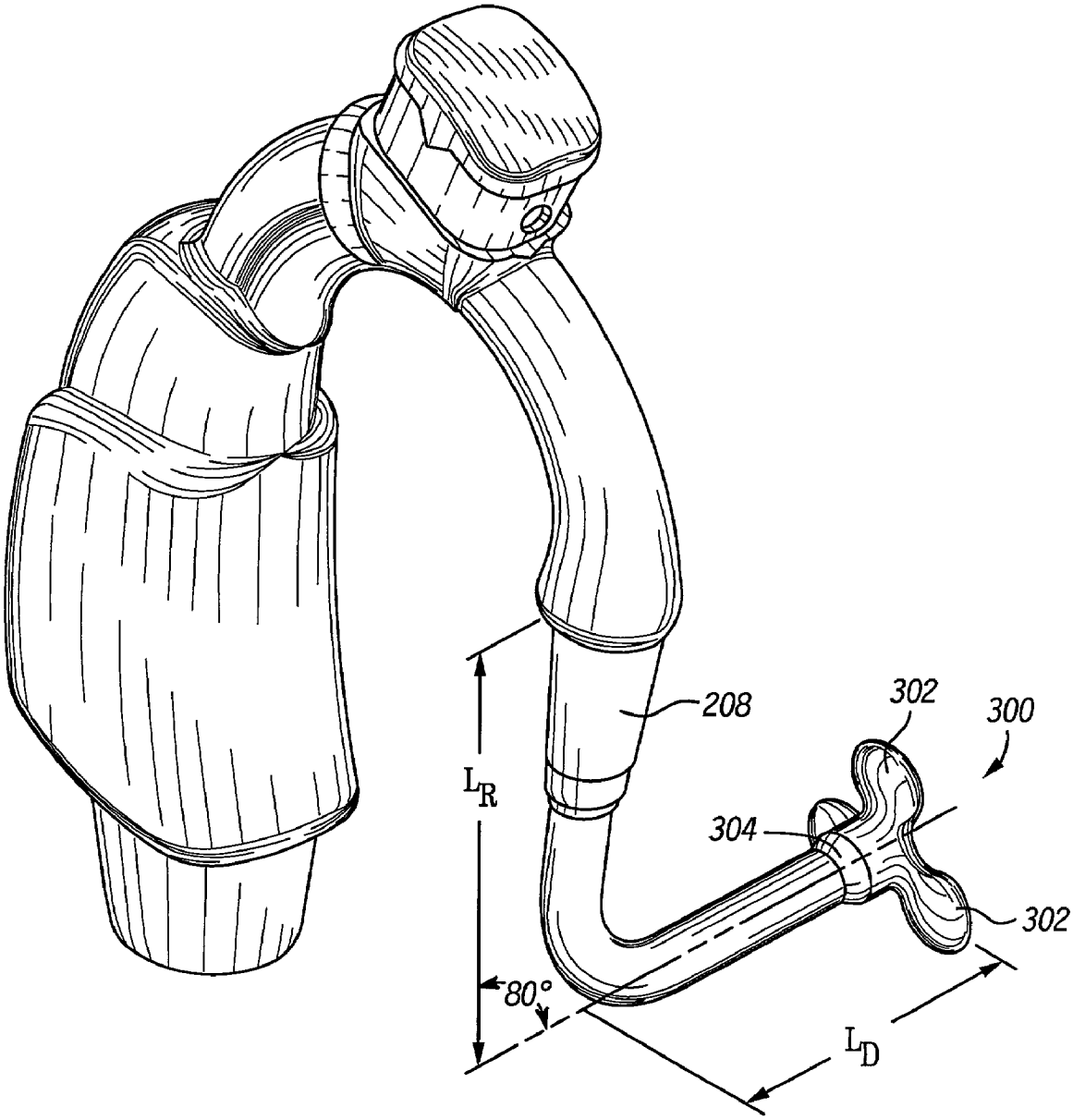
FIG. 3 illustrates a sound delivery tube and eartip in accordance with the preferred embodiment of the present invention.

In the preferred embodiment of the present invention, the BTE communication device 200 has one sound delivery tube 210 intended to fit all users. Because of the design, the sound delivery tube 210 is compliant to fit a broad range of ears. As illustrated in FIG. 3, the sound delivery tube 210 is substantially L-shaped with a preferred angular orientation of approximately eighty degrees to anatomically match the entrance angle of the ear canal 102. The sound delivery tube 210 has a run length $L_R$ between the terminal end 208 and the lowest part of the tube 210 where the tube 210 bends to enter the ear canal 102. A distance between the point where the tube 210 bends to enter the ear canal 102 and an end of an eartip 300 is called a duck-in-length $L_D$.

The eartip 300 illustrated in the figures is a flower-shaped eartip formed of a resilient material that includes three flower petals 302 extending from a base 304 in the preferred embodiment. A sound output opening (not shown) is provided at the center of the flower-shaped eartip 300 for delivering sound to the ear canal 102. The eartip 300 retains the end of the sound delivery tube 210 in position within the user's ear canal 102 by engaging the walls of the ear canal 102 with uniform pressure with the resilient petals of the flower 302. In other words, the eartip 300 assists in maintaining concentricity of at least a portion of the sound delivery tube 210 with respect to the ear canal axis 218 (preferably the center line of the ear canal) for the purposes of comfort for long term use, and to provide sound that can be acoustically coupled with the ear canal 102 in a non-occluded fashion (i.e., non-restricting to any environmental sounds entering the ear). Thus, the eartip 300 has flower petals 302 spaced around the opening of the sound delivery tube 210 such that the sound delivery tube is non-occluding to allow it to easily adjust to different ear canal depths while preventing the eartip from digging into and/or abrading the soft skin lining of the ear canal 102.

The flower-shaped eartip 300 is only one example of an eartip that may be used with the present invention. Many other eartip shapes may also be used, including, but not limited to, bud-shaped eartips, guppy-shaped eartips, and the like. Other shapes and constructions of custom earmold eartips and stock eartips may also be connected to the sound delivery tube 210 according to the present invention. Also, occluding eartips may be connected to the sound delivery tube 210 according to the present invention.

The sound delivery tube 210 is also preferably formed of a resilient material (e.g., a soft rubbery material) that flexes to accommodate differences in ear dimensions and angles. Preferably, the sound delivery tube 210 has sufficient resiliency to return to its original shape when not subject to external forces. The flexibility of the material used for the sound delivery tube 210 allows one size tube to fit substantially all ear shapes and sizes. Alternatively, the sound delivery tube 210 may be formed of a more rigid material. A rigid sound delivery tube 210 may be provided in different sizes with run lengths $L_R$ and duck-in-lengths $L_D$ varying for different users. Thus, the sound delivery tube 210 may be formed of any suitable material, such as, plastic, silicone rubber, or the like.

In the preferred embodiment, the sound delivery tube 210 is infinitely adjusted through friction whereby the position of the sound delivery tube 210 is maintained until adjusted again; alternatively, the sound delivery tube 210 is indexed along the pivot axis 212, or similar mechanism, in order to maintain its newly adjusted position. Thus, the user can maximize the sound level by adjusting the sound delivery tube 210 deeper into the ear canal 102, or conversely, minimize the sound level by adjusting the sound delivery tube 210 shallowly in the ear canal 102. Thus, in accordance with the present invention, the design of the BTE communication device 200 allows it to be worn at various depths into the user's ear canal 102 based on personal preference sound level, and comfort.

While the invention has been described in conjunction with specific embodiments thereof, additional advantages and modifications will readily occur to those skilled in the art. The invention, in its broader aspects, is therefore not limited to the specific details, representative apparatus, and illustrative examples shown and described. Various alterations, modifications and variations will be apparent to those skilled in the art in light of the foregoing description. Thus, it should be understood that the invention is not limited by the foregoing description, but embraces all such alterations, modifications and variations in accordance with the spirit and scope of the appended claims.

I claim:

1. A communication device for use behind the ear, comprising:

a housing having a first section and a second section; and a sound delivery tube coupled to the second section of the housing, wherein the second section of the housing rotates with respect to the first section of the housing within a prescribed range of angular displacement as to allow user-definable depth adjustability of at least a portion of the sound delivery tube into an ear canal.

2. The communication device of claim 1 wherein the prescribed range of angular displacement allows up to approximately fifteen degrees of angular displacement on at least one side of a neutral axis.

3. The communication device of claim 1 wherein the first section of the housing rotates with respect to the second section of the housing within a second prescribed range of angular displacement.

4. The communication device of claim 3 wherein the second prescribed range of angular displacement allows up to approximately fifteen degrees of angular displacement on at least one side of a neutral axis.

5. The communication device of claim 3 wherein the rotation of the first section of the housing with respect to the second section of the housing and the rotation of the second section of the housing with respect to the first section of the housing occurs in tandem.

6. The communication device of claim 3 wherein the rotation of the first section of the housing with respect to the second section of the housing is independent from the rotation of the second section of the housing with respect to the first section of the housing.

7. The communication device of claim 3 wherein the rotation of the first section of the housing with respect to the second section of the housing is dependent on the rotation of the second section of the housing with respect to the first section of the housing.

8. The communication device of claim 1 wherein a position of the sound delivery tube is maintained via friction.

9. The communication device of claim 1 wherein the sound delivery tube comprises an eartip, and the eartip assists in maintaining concentricity of at least a portion of the sound delivery tube with respect to an ear canal axis.

10. The communication device of claim 1 further comprising a pivot, and wherein a position of the sound delivery tube is maintained via indexes in the pivot.

11. The communication device of claim 1 further comprising a pivot axis perpendicular to a pivot plane, wherein the pivot plane does one of the following: intersects an ear canal axis, lies within approximately fifteen degrees above the ear canal axis, and lies within fifteen degrees below the ear canal axis.

12. The communication device of claim 11 further comprising an intersecting axis on the pivot plane.

13. The communication device of claim 11 wherein the pivot axis couples the first section of the housing with the second section of the housing.

14. The communication device of claim 1 further comprising electronic circuitry connected to at least one of the first section and the second section of the housing.

15. The communication device of claim 1 wherein the sound delivery tube is flexible.

16. The communication device of claim 1 wherein the sound delivery tube is semi-rigid.

17. The communication device of claim 1 wherein the sound delivery tube is constructed from a material selected from a group consisting of: rubber and plastic.

18. A method comprising the steps of:

providing a housing having a first section and a second section;

providing a sound delivery tube coupled to the second section of the housing; and rotating the second section of the housing with respect to the first section within a prescribed range of angular displacement as to allow user-definable depth adjustability of at least a portion of the sound delivery tube into an ear canal.

19. The method of claim 18 further comprising the step of maintaining concentricity of at least a portion of the sound delivery tube with respect to an ear canal axis.

* * * * *